United States Patent [19]

Szegda

[11] Patent Number: 4,676,577

[45] Date of Patent: Jun. 30, 1987

[54] CONNECTOR FOR COAXIAL CABLE

[75] Inventor: Andrew Szegda, Canastota, N.Y.

[73] Assignee: John Mezzalingua Associates, Inc., Manlius, N.Y.

[21] Appl. No.: 716,745

[22] Filed: Mar. 27, 1985

[51] Int. Cl.[4] ..... H01R 17/18

[52] U.S. Cl. ..... 439/584

[58] Field of Search ..... 339/177 R, 177 E, 143 R, 339/89 C, 90 C

[56] References Cited

U.S. PATENT DOCUMENTS

| | | | |
|---|---|---|---|
| 3,671,926 | 6/1972 | Nepovim | 339/177 E |
| 3,686,623 | 8/1972 | Nijman | 339/177 E |
| 3,744,011 | 7/1973 | Blanchenot | 339/177 R |
| 3,761,876 | 9/1973 | Drezin et al. | 339/177 R |
| 3,847,463 | 11/1974 | Hayward et al. | 339/177 R |
| 3,879,102 | 4/1975 | Horak | 339/177 |
| 4,346,958 | 8/1982 | Blanchard | 339/177 |
| 4,491,685 | 1/1985 | Drew et al. | 339/177 E |

OTHER PUBLICATIONS

Magnavox CATV—Full Line Catalog, 1979, p. 60—Trimline Cable Connector.

Magnavox CATV—U-Series Universal Connectors, Jul. 1974.

Magnavox CATV—1981 Magnavox MX Line.

*Primary Examiner*—Gil Weidenfeld

*Assistant Examiner*—David Pirlot

*Attorney, Agent, or Firm*—I. Stephen Samuels

[57] ABSTRACT

A coaxial cable connector having a body assembly and a cap assembly which are adapted to be secured together. The body assembly has a front body with a front body cavity formed therein, an electrically conductive collet affixed at least partially within the front body cavity, an axially moveable electrically insulative seizure bushing fitted within the front body cavity, an axially moveable mandrel fitted within the front body cavity and extending beyond said front body, and a spring fitted within the front body cavity for urging the seizure bushing towards an open position. The cap assembly has a cap body with a substantially open passage therethrough, and an outer conductor clamp fitted within the passage. The front body also has a bevelled surface proximate the open end of the front body cavity for engaging and constricting the outer conductor clamp upon joining of the body assembly to the cap assembly. The outer conductor clamp has a pusher surface for moving the mandrel from its open position towards its closed position upon joining of the body assembly to the cap assembly, thereby urging the seizure bushing towards its closed position to engage and constrict the collet.

6 Claims, 7 Drawing Figures

CONNECTOR FOR COAXIAL CABLE

BACKGROUND OF THE INVENTION

This invention relates generally to electrical connecting devices and more particularly concerns a two-piece connector for coaxial cable which is simplified in construction and enhanced in operation.

Two-piece coaxial cable connectors have long been known to the art, but such prior two-piece coaxial cable connectors have each had drawbacks in construction and operation which did not assure selective positive retention and positive release of the coaxial cable and had other shortcomings which made them less reliable in use, handling and assembly than the present invention. A reliable and easy to handle two-piece coaxial connector having selective positive retention and positive release of a coaxial cable is particularly necessary in the community antenna television (CATV) industry, where connections of coaxial cable are often made atop utility poles or in other conditions which are both difficult to access and subject the connector and cable to temperature and weather extremes. In such environments, ease of handling, positive retention, release and reusability are essential.

These prior coaxial connectors have several shortcomings which are obviated by the connector of the present invention. For example, the center conductor seizure mechanism of prior connectors used in the CATV industry have a tendency to "hang up" when the connector assemblies are uncoupled and, as a result, the center conductor of the cable may not release when desired. Second, the bodies of prior coaxial connectors used in the CATV industry have a tendency to deform and splay when the connector is tightened. Third, the outer conductor clamps of prior connectors used in the CATV industry have a tendency to twist when the connector assemblies are tightened together and possibly damage the outer conductor. None of these shortcomings is present in the coaxial conductor of the present invention.

SUMMARY OF THE INVENTION

The present invention overcomes the limitations associated with prior coaxial cable connectors by providing an apparatus which assures positive, simultaneous seizure of the inner conductor and outer conductor when the connector is tightened and positive release of the inner and outer conductors when the connector is loosened. The present invention further overcomes the limitations associated with prior coaxial connectors by providing a connector having a body which resists splaying when the connector is tightened. The present invention further overcomes the limitations associated with prior coaxial cable connectors by providing an apparatus which effectively restrains the outer sheath of the coaxial cable without subjecting it to possibly damaging twisting forces.

Accordingly, it is an overall object of the present invention to provide a two-piece coaxial connector which may be utilized in CATV systems or other environments in which reliability and ease of assembly is necessary.

It is a further object of this invention to provide a coaxial cable connector in which positive, simultaneous seizure of the center conductor and outer conductor of the cable occurs when the connector is tightened and positive release of the center and outer conductor occurs when the connector is loosened.

It is still a further object of this invention to provide a coaxial cable connector in which the connector body does not splay upon tightening of the connector.

It is yet a further object of this invention to provide a coaxial connector which effectively retains the outer sheath of the coaxial cable without subjecting it to possibly damaging twisting forces.

In accordance with the present invention, there is provided a connector body assembly and a connector cap assembly which are adapted to be secured together to form the complete coaxial connector.

The body assembly has a front body with a front body cavity formed therein which has at least one open end. An electrically conductive collet is affixed at least partially within the front body cavity and has a center conductor receiving portion which is open towards the open end of the cavity. An electrically insulative seizure bushing is positioned within the front body cavity and is movable from a first, open position towards a second, closed position to engage and constrict the center conductor receiving portion of the collet. A mandrel is partially fitted within the front body cavity and partially extends beyond the front body cavity. The mandrel abutts the seizure bushing and is movable with it from a first, open position toward a second, closed position. A spring is also fitted within the front body cavity to urge the seizure bushing towards its first, open position.

The cap assembly includes a cap body having a substantially open passage therethrough and an outer conductor clamp fitted within the passage. The front body has a bevelled surface proximate the open end of the front body cavity for engaging and constricting the outer conductor clamp when the body assembly and the cap assembly are joined. The outer conductor clamp has a pusher surface which moves the mandrel from its first, open position towards its second, closed position upon joining of the body assembly to the cap assembly and thereby urges the seizure bushing towards its second, closed position to engage and constrict the center conductor receiving portion of the collet.

BRIEF DESCRIPTION OF THE DRAWINGS

The above objects, aspects and advantages of the invention, as well as others, will be apparent from the detailed description of the preferred embodiment of the invention considered in conjunction with the drawings, which should be considered in an illustrative and not in a limiting sense, as follows.

DETAILED DESCRIPTION OF THE PREFERRED EMBODIMENT OF THE INVENTION

Figure 1:
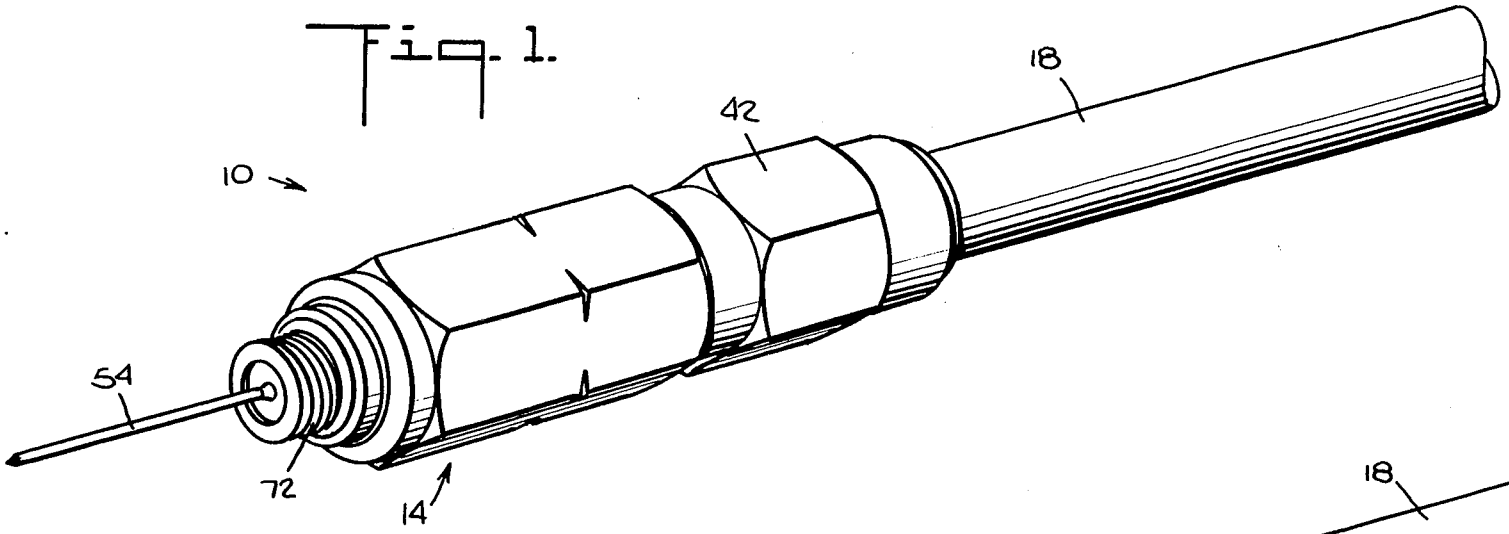
FIG. 1 is a perspective view of the coaxial cable connector of the present invention showing the body assembly and cap assembly tightly joined together with a coaxial cable inserted therein.

Referring to FIG. 1, the coaxial connector 10 is shown fully assembled with a coaxial cable 12 secured therein. The coaxial connector 10 consists of a body assembly 14 and a cap assembly 16.

Figure 2:
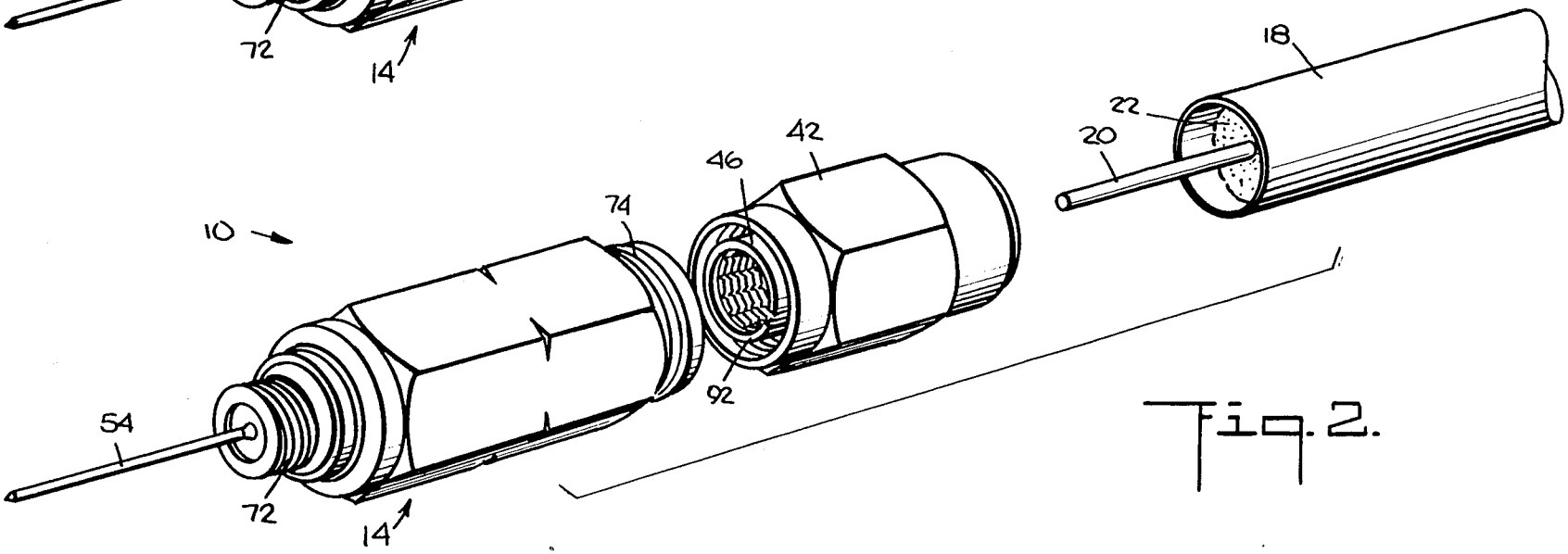
FIG. 2 is an exploded, perspective view of the coaxial cable connector of the present invention showing the body assembly, cap assembly and coaxial cable.

As seen in FIG. 2, the coaxial cable 12 concentrically includes an outer conductor 18, a center conductor 20 and a di-electric 22.

Figure 3:
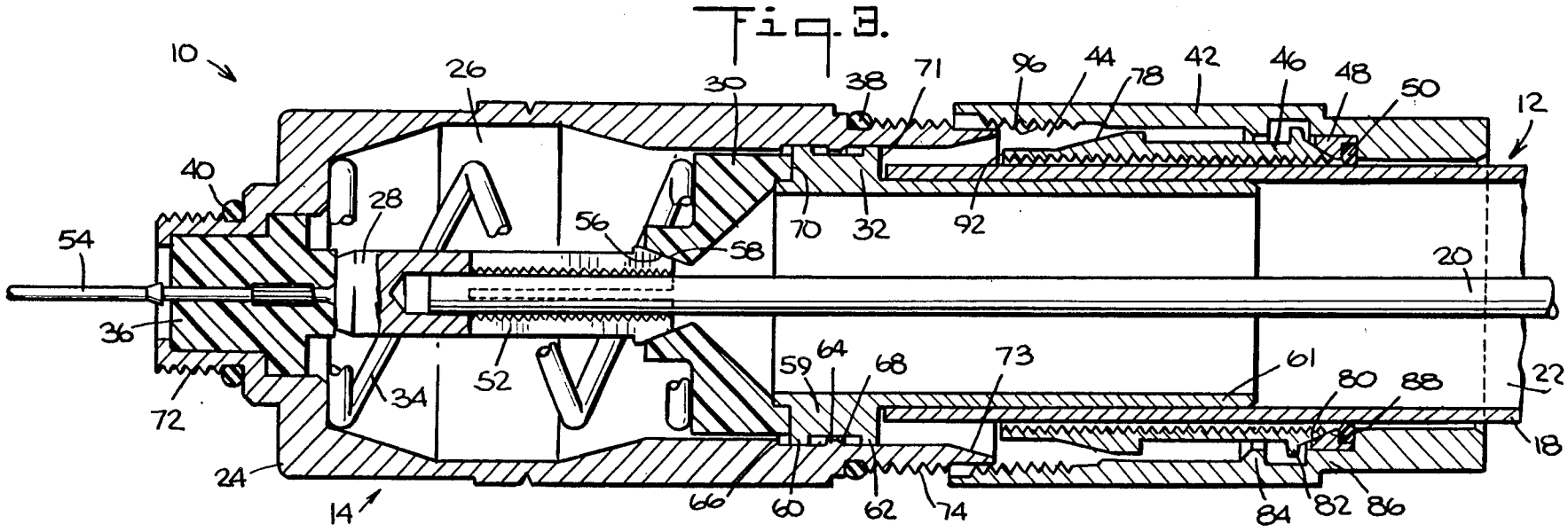
FIG. 3 is a section of the coaxial connector of the present invention showing the body assembly, cap assembly and coaxial cable in loose engagement.

Referring to FIG. 3, it is seen that the body assembly 14 includes a front body 24, having a front body cavity 26, an electrically conductive collet 28, an electrically insulative seizure bushing 30, a mandrel 32, a spring 34, an insulator 36 and O-rings 38 and 40. The cap assembly 16 includes a cap body 42, having a substantially open passage 44 therethrough, an outer conductor clamp 46, a clamp ring 48 and an O-ring 50.

The front body cavity 26 is open at its rear to receive a portion of the coaxial cable 12, and houses the electrically conductive collet 28, the electrically insulative seizure bushing 30, the mandrel 32, the spring 34 and the insulator 36. The front body cavity 26 is preferably tapered to minimize discontinuous changes in impedance of the connector and thus minimize reflections of signals carried by the coaxial cable 12 and through the coaxial connector 10. Signal reflections caused by impedance discontinuities are particularly troublesome in high frequencies above 500 MHz. Tapering of coaxial connector body cavities to minimize reflection is discussed in an article by Bradford S. Kellar, entitled "Connector Return Loss Measurement" and appearing in *Communications Engineering & Design* in November 1984. The other end of the front body cavity 26 is closed by the insulator 36 which is fixed within the forward end of the front body 24.

The electrically conductive collet 28 is press-fit into insulator 36 which assembly is then press-fit into the front body 24. The electrically conductive collet 28 has a center conductor receiving portion 52 which is open towards the open end of the front body cavity 26, generally rear of the electrically conductive collet 28, and a terminal portion 54 which extends through and beyond the insulator 36. The electrically insulative seizure bushing 30 is fitted within the front body cavity 26 and is axially movable relative to the front body 24 and electrically conductive collet 28. The center conductor receiving portion 52 of the electrically conductive collet 28 has a camming surface 56 which interacts with a camming surface 58 of the electrically insulative seizure bushing 30 to radially constrict the center conductor receiving portion 52 of the electrically conductive collet 28 as the electrically insulative seizure bushing 30 moves axially from a first, open position towards a second, closed position. The spring 34 is mounted within the front body cavity 26, generally between the insulator 36 and seizure bushing 30, and biases the electrically insulative seizure bushing 30 towards its first, open position.

The mandrel 32 has a forward portion 59 which includes a first boss 60 and a second boss 62 and is mounted within the front body cavity 26, generally rearward of the seizure bushing 30. The first boss 60 is of a diameter which is sized to enable it to be pushed past a first shoulder 64 formed within the front body 24 but unable to be pushed passed a second shoulder 66 formed within the front body 24. The mandrel 32 may move axially within the front body cavity 26 between a first, open position in which the first boss 60 is generally adjacent the first shoulder 64 and a second, closed position in which the first boss 60 is generally adjacent the second shoulder 66. The rear surface 68 of the first shoulder 64 is preferably configured as a ramp which facilitates pushing the first boss 60 of the mandrel 32 passed the first shoulder 64 of the front body 24. The mandrel 32 has a cylindrical portion 61 which extends beyond the front body 24. The forward portion 59 of the mandrel 32 has a front surface 70 which abutts the electrically insulative seizure bushing 30 so that the electrically insulative seizure bushing 30 moves from its first, open position towards its second, closed position, as the mandrel 32 moves from its first, open position towards its second, closed position. The front body 24 is provided with forward external screw threads 72 to permit screw engagement of the connector 10 to equipment, and rear, external screw threads 74 to permit screw engagement of the body assembly 14 to the body assembly 16.

Figure 6:
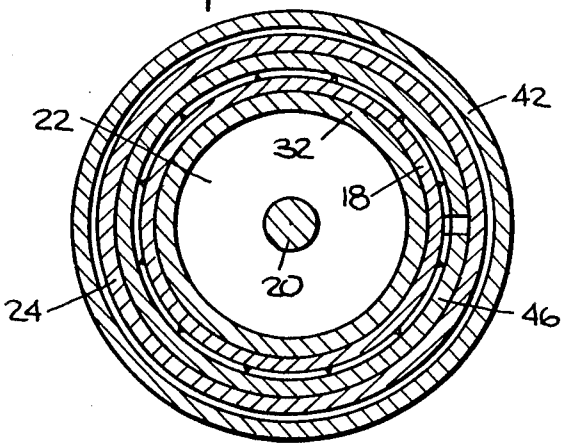
FIG. 6 is a section of the cap assembly taken on line 6—6 of FIG. 4, looking in the direction of the arrows.
Figure 5:
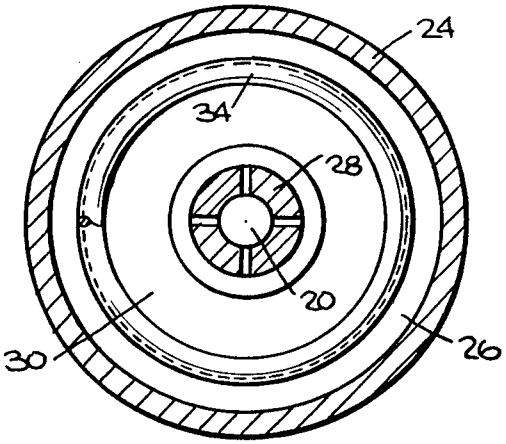
FIG. 5 is a section of the body assembly taken on line 5—5 of FIG. 4, looking in the direction of the arrows.

As seen in FIGS. 2 and 6, the cap body 42 includes inner threads 90 which are configured to be joined with the rearward external screw threads 74 of the front body 24. The outer conductor clamp 46 is mounted within the passage 44 of the cap body 42. The outer conductor clamp 46 is axially split along a slot 76 and includes a forward ramp 78, a rear ramp 80, and a boss 82. The boss 82 of the outer conductor clamp 46 is sized so that upon radial compression of the outer conductor clamp 46, it can be pushed passed a first shoulder 84 of the cap body 42 and axially move between the first shoulder 84 and a second shoulder 86 of the cap body 42. The clamp ring 48 is force-fitted within the passage 44 of the cap body 42 between an O-ring 50 at the rear of the passage 44 and the outer conductor clamp 46. The clamp ring 48 includes a ramp 88 which is juxtaposed with the rearward ramp 80 of the outer conductor clamp 42. The forward ramp 78 of the outer conductor clamp 46 is preferably knurled.

The outer conductor clamp 46 has a front surface 92 which is adapted to abutt the second shoulder 71 of the mandrel 32 and urge the mandrel 32 from its first, open position to its second, closed position as the body assembly 14 is joined with the cap assembly 16 by threading of the inner threads 90 of the cap body 42 onto the rearward external threads 74 of the front body 24.

Assembly of the body assembly 14 to the cap assembly 16, and to one end of a coaxial cable 12, comprises several steps: The coaxial cable 12 is prepared with the center conductor 20 extending beyond both the dielectric 22 and the outer conductor 18. The dielectric 22 is partially cut away from the forward end of the coaxial cable 12 to form an annular space between the center conductor 20 and outer conductor 18. The cap assembly is slid over the outer conductor 18 so that the outer conductor 18 is loosely gripped by the outer conductor clamp 46. The center conductor 20 is slid into the center conductor receiving portion 52 of the electrically conductive collet 28 of the cap assembly 16. The cap assembly 16 is screwed onto the body assembly 14. As the cap assembly 16 is then screwed onto the body assembly 14, the front surface 92 of the outer conductor clamp 46 abutts the rearward surface 71 of the mandrel 32 and urges it from its first, open position towards its second, closed position thereby causing the center conductor receiving portion 52 of the electrically conductive collet 28 to seize and compress the inner conductor 20 of the coaxial cable 12. Pressurized contact between surfaces 66 and 70 creates an RF seal, preventing signal leakage, especially at high frequencies.

Simultaneously, the rearward ramp 73 of the front body 24 engages the forward ramp 78 of the outer conductor clamp 46 and the ramp 88 of the clamp ring 48 engages the rearward ramp 80 of the outer conductor clamp 46, thereby radially constricting the outer conductor clamp 46 and causing the outer conductor 18 of the coaxial cable 12 to be seized between the outer conductor clamp 46 and mandrel 32. The knurling of the forward ramp 78 of the outer conductor clamp 46 frictionally engages the rearward ramp 73 of the front body 24 to prevent the outer conductor clamp 46 from rotating as the cap assembly 16 is screwed onto the body assembly 14. Simultaneously, the clamp ring 48 compresses the O-ring 50 to provide an effective seal against moisture and other contaminants. The O-ring 40 provides a seal between the cap assembly 16 and body assembly 14.

Figure 4:
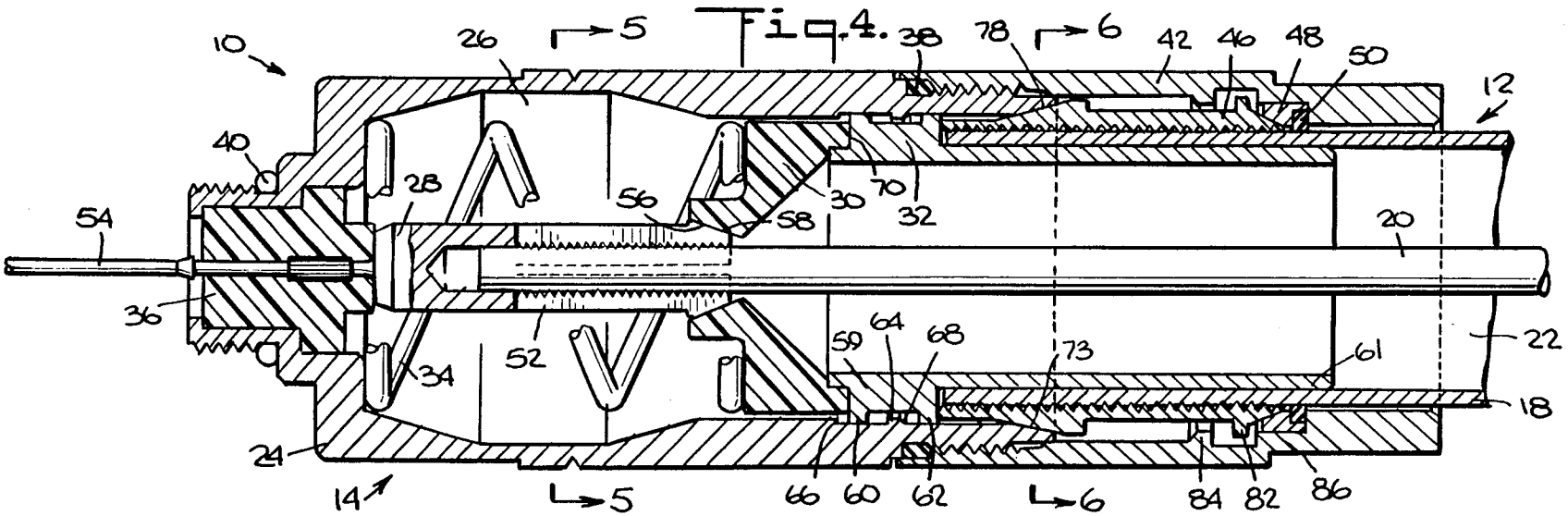
FIG. 4 is a section of the coaxial connector of the present invention showing the body assembly, cap assembly and coaxial cable tightly joined together.

Although the rearward portion of the front body 24, coextensive with the rearward ramp 73, is subjected to considerable radially outward pressure by the forward ramp 78 of the outer conductor clamp 46, as the body assembly 14 and cap assembly 16 are tightened together, as seen in FIG. 4, the rearward portion of the front body 24 is restrained from flaring by abutment with the unthreaded interior surface of the passage 44 of the cap body 42. The abutment also provides added sealing as well as added resistance to possible loosening of cap assembly 16 from body assembly 14 due to stresses that could be created from vibration.

To disassemble the connector and disengage the coaxial cable, the body assembly 14 and cap assembly 16 are unscrewed. The spring 34 urges the electrically insulative seizure bushing 30 and with it mandrel 32 towards their first, open position and provides positive release of both the center conductor 20 from the center conductor receiving portion 52 of the electrically conductive collet 28 and the outer conductor 18 from between the clamp ring 48 and mandrel 32.

Figure 7:
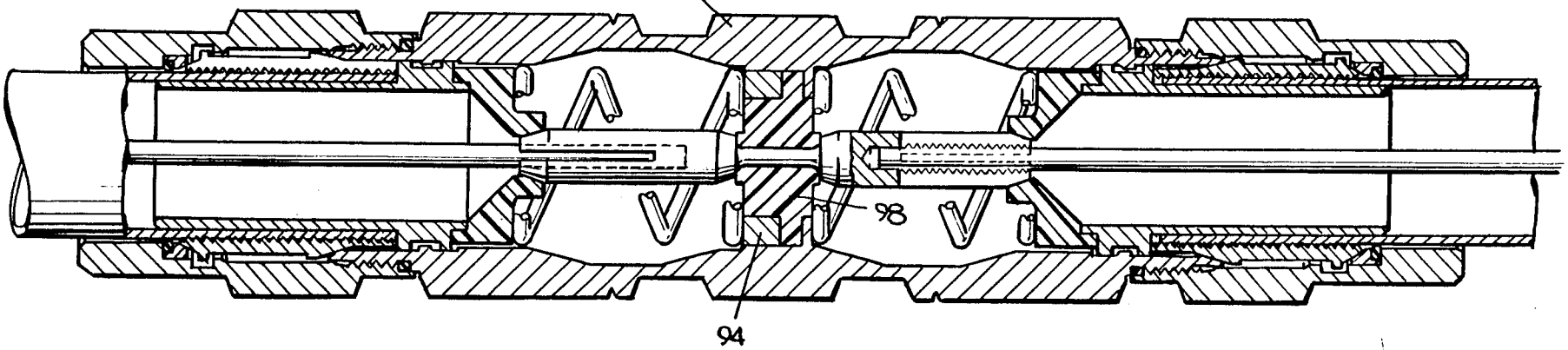
FIG. 7 is a section of an alternate embodiment of the coaxial connector of the present invention, showing a coaxial cable splice in fully assembled form.

An alternative, splice connector embodiment of the present invention is shown in FIG. 6. Each of the elements of the invention found in the embodiments of FIG. 1 through 6 of the present invention are found in FIG. 7 and are indicated by like referenced numbers. The splice embodiment of FIG. 7 includes as an additional element a retaining ring 94 which is force-fitted within the splice front body 96 and into which the splice insulator 98 is force-fitted. The remaining elements in operation of the splice embodiment of FIG. 7 are the same as the embodiments of FIGS. 1 through 6, and need not be described again.

It should be apparent to those skilled in the art that a latitude of modification, change and substitution is intended in the foregoing disclosure. Accordingly, it is appropriate that the appended claims be construed broadly and in a manner consistent with the spirit and scope of the invention.

What is claimed is:

1. A coaxial cable connector comprising:

a body assembly and a cap assembly which are adapted to be secured together;

said body assembly comprising:

a front body having a front body cavity formed therein, said front body cavity having at least one open end, and said front body having a first radial shoulder, and a second radial shoulder axially spaced relative to said first radial shoulder within said front body cavity;

an electrically conductive collet affixed at least partially within said front body cavity, said collet having a center conductor receiving portion which is open towards said open end of said front body cavity;

an electrically insulative seizure bushing means fitted within said front body cavity and movable from a first position towards a second position to engage and constrict said center conductor receiving portion of said collet;

a mandrel having a forward portion closely fitted within said front body cavity and a rearward portion having a smaller cross-section than said forward portion, said forward portion of said mandrel abutting said seizure bushing means, said mandrel being movable from a first position towards a second position in concert with said seizure bushing means, and said mandrel having boss means formed thereon for restricting the range of movement of said mandrel between said first radial shoulder and said second radial shoulder; and a spring means fitted within said front body cavity for urging said seizure bushing means towards its first position;

said cap assembly comprising:

a cap body having a substantially open passage therethrough; and an outer conductor clamp fitted within said passage;

said front body having beveled surface means proximate said open end of said front body cavity for engaging and constricting said outer conductor clamp upon the joining of said body assembly to said cap assembly; and said outer conductor clamp having pusher surface means for moving said mandrel from its first position towards its second position upon the joining of said body assembly to said cap assembly, thereby urging said seizure bushing means towards its second position to engage and constrict said center conductor receiving portion of said collet.

2. A coaxial cable connector comprising:

a body assembly and a cap assembly which are adapted to be secured together;

said body assembly comprising:

a front body having a front body cavity formed therein, said front body cavity having at least one open end, and said front body having a radial shoulder; an electrically conductive collet affixed at least partially within said front body cavity, said collet having a center conductor receiving portion which is open towards said open end of said front body cavity;

an electrically insulative seizure bushing menas fitted within said front body cavity and movable from a first position towards a second position to engage and constrict said center conductor receiving portion of said collet;

a mandrel having a forward portion closely fitted within said front body cavity and a rearward portion having a smaller cross-section than said forward portion, said forward portion of said mandrel abutting said seizure bushing means, said mandrel being movable from a first position towards a second position in concert with said seizure bushing means, and said forward portion of said mandrel abutting said radial shoulder when said mandrel is in said second position; and a spring means fitted within said front body cavity for urging said seizure bushing means towards its first position;

said cap assembly comprising:

a cap body having a substantially open passage therethrough; and an outer conductor clamp fitted within said passage;

said front body having beveled surface means proximate said open end of said front body cavity for engaging and constricting said outer conductor clamp upon the joining of said body assembly to said cap assembly; and said outer conductor clamp having pusher surface means for moving said mandrel from its first position towards its second position upon the joining of said body assembly to said cap assembly, thereby urging said seizure bushing means towards its second position to engage and constrict said center conductor receiving portion of said collet.

3. The coaxial cable connector recited in claim 1 or claim 2, wherein:

said body assembly further comprises an insulator fitted within said front body cavity in a position opposite said open end, said insulator surrounding and supporting at least a portion of said collet.

4. The coaxial cable connector recited in claim 1 or claim 2, wherein:

said cap assembly further comprises an elastomeric O-ring fitted within said passage and in alignment therewith and a clamp ring means fitted within said passage for radially compressing said outer conductor clamp upon the joining of said body assembly to said cap assembly.

5. The coaxial connector recited in claim 1 or claim 2, wherein:

said outer conductor clamp has knurl means on its external surface for retarding rotational movement of said outer conductor clamp upon the joining of said body assembly to said cap assembly.

6. The coaxial connector recited in claim 1 or claim 2, wherein:

the exterior surface of said front body which is adjacent said beveled surface means abuts the interior surface of said passage of said cap body upon the joining of said body assembly to said cap assembly.

* * * * *